US005088918A

United States Patent [19]

Schaale et al.

[11] Patent Number: 5,088,918

[45] Date of Patent: Feb. 18, 1992

[54] VAPORIZATION BURNER FOR A HEATER OPERATED WITH LIQUID FUEL

[75] Inventors: Klaus Schaale, Krailling; Wolfgang Engelhardt, Munich, both of Fed. Rep. of Germany

[73] Assignee: Webasto AG Fahrzeugtechnik, Stockdorf, Fed. Rep. of Germany

[21] Appl. No.: 650,015

[22] Filed: Feb. 4, 1991

[30] Foreign Application Priority Data

Feb. 2, 1990 [DE] Fed. Rep. of Germany ..... 4003090

[51] Int. Cl.[5] ..... F23C 11/00

[52] U.S. Cl. ..... 431/326; 431/261; 431/350; 431/353

[58] Field of Search ..... 431/326, 327, 328, 329, 431/261, 262, 350, 353, 330, 333, 298, 299, 300, 208; 237/12.3 R, 12.3 C; 126/110 R, 116 R

[56] References Cited

U.S. PATENT DOCUMENTS 2,966,944 1/1961 Downs ..... 431/329
4,818,219 4/1989 Widemann et al. ..... 431/261

FOREIGN PATENT DOCUMENTS 2256500 6/1974 Fed. Rep. of Germany .
3914611 12/1989 Fed. Rep. of Germany .
3900438 7/1990 Fed. Rep. of Germany ..... 237/12.3 C

*Primary Examiner*—Carl D. Price
*Attorney, Agent, or Firm*—Sixbey, Friedman, Leedom & Ferguson

[57] ABSTRACT

A vaporization burner for a heater operated with liquid fuel, in particular an auxiliary vehicle heater with a support that projects into a combustion chamber and on whose front side facing the combustion chamber an absorbent body is located that is supplied with fuel by a fuel feed pipe and on whose back side there is connected an ignition chamber that contains an igniter, for which a passage to the combustion chamber is provided in the support. To achieve improved combustion performance, especially in the start-up phase, with even fuel and heat distribution over the absorbent body, according to a preferred embodiment, a perforated disk is placed between the support and the absorbent body that has a through-hole in the area of a passage in the support and also has a slot-shaped notch which runs from the through-hole up the the edge of perforated disk.

20 Claims, 1 Drawing Sheet

VAPORIZATION BURNER FOR A HEATER OPERATED WITH LIQUID FUEL

BACKGROUND OF THE INVENTION

The invention relates to a vaporization burner for a heater operated with liquid fuel, in particular an auxiliary vehicle heater with a support that projects into a combustion chamber and on whose front side facing the combustion chamber there is placed an absorbent body that can be supplied with fuel by a fuel feed pipe and on whose back side there is connected an ignition chamber that contains an igniter, for which a passage to combustion chamber is provided on the support.

In such a vaporization burner known from German Offenlegungsschrift 39 14 611, in which the support has a through-hole for a flame monitor projecting into the combustion chamber, it has turned out that in especially critical installation positions, such as with vertical installation of the heater, difficulties can result with respect to the fuel distribution in the area of the absorbent body being uneven. In some cases, when this happens, fuel can escape in the area of the support and of the absorbent body. Further, this uneven fuel distribution results in an uneven and fluctuating combustion, which is unsatisfactory with respect to CO emissions in the exhaust gas.

From German Offenlegungsschrift 22 56 500 there is known a device to atomize and/or vaporize a liquid in a gas stream, a device that comprises a porous body through which the gas stream flows and that is wetted by the liquid, and an upstream perforated disk. It can be used to vaporize fuel droplets and to atomize them to generate a fuel-air mixture in internal combustion engines.

SUMMARY OF THE INVENTION

In view of the foregoing a primary object of the present invention is to provide a vaporization burner of the initially-mentioned type for a heater operated with liquid fuel, in particular an auxilary vehicle heater, in which an improved combustion performance can be achieved, especially in the start-up phase, with even fuel and heat distribution over the absorbent body.

According to a preferred embodiment of the invention, this object is achieved by placing a perforated disk between the support and the absorbent body that has a through-hole in the area of a passage in the support and also has a slot-shaped notch which runs from the through-hole up to the edge of perforated disk. In this embodiment of the vaporization burner, it has turned out that, with the help of the perforated disk between the absorbent body, such as a ceramic body, and the support, an even fuel distribution can be achieved as a result of a capillary action that occurs between the front side of the support body and the perforated disk because of the perforation pattern present. Further, thanks to the perforation pattern of the perforated disk, the fuel entering through the fuel feed pipe is divided into numerous partial streams over the support area. Because of this evened-out fuel distribution, a heater with such a vaporization burner can also be operated reliably in a vertical installation position without the exhaust gases having increased CO content, especially during start-up.

To provide compensation for varying thermal expansion effects and to achieve a secure setting of the perforated disk against the front side of the support, the perforated disk is provided, starting from the through-hole that lies in the area of the passage on the support from the ignition chamber to the combustion chamber, with a slot-shaped notch extending to the outer edge of the perforated disk. With the help of this narrow gap formed by the notch, a bulging of the perforated disk at the temperatures occurring during combustion operation is substantially prevented there, so that a close contact between perforated disk and support results.

To achieve a better heat distribution on the absorbent body in the area of the transition from the ignition chamber into the combustion chamber, the perforated disk has a through-hole in the area of the passage on the support from the ignition chamber to the combustion chamber. With such a configuration, the perforated disk can also be placed between the igniter, such as a glow plug in the ignition chamber, and the absorbent body of the vaporization burner, so that a more even temperature distribution is achieved because of the heat conduction of the perforated disk. Simultaneously, the flame can also be stabilized during movement from the ignition chamber to the combustion chamber, making it possible to still further improve the combustion behavior of such a vaporization burner. Preferably, the through-hole is smaller than the passage of the support.

In the preferred embodiment of the vaporization burner according to the invention, it has additionally turned out that variations in the fiber structure of the ceramic body serving as an absorbent body have no disruptive influence on the combustion performance of the vaporization burner. Soot formation in the area of the ignition chamber and of the absorbent body is also counteracted, so that the long-term operating performance of such a vaporization burner can be considerably improved.

Considering the size and number of the perforations in the perforated disk, it has turned out to be a tendency that the number of perforations of the perforated disk is to be selected to be higher if the perforation diameter of the perforations is selected to be smaller. Here it is essential that the perforation pattern of the perforated disk reliably results in capillary action between the support and the perforated disk to even out the fuel distribution. For this reason, the perforations on the perforated disk are evenly distributed. By configuring the perforations to have a diameter of about 2 to 2.2 mm, results that are favorable from a manufacturing viewpoint can be achieved without too great a production expense.

An embodiment in which the support has a through-hole for a flame monitor projecting into combustion chamber, and has another through-hole of a size corresponding to the diameter of the through-hole for flame monitor results not only in the flame monitor being able to be conducted through the perforated disk, but simultaneously in the use of this through-hole, which is considerably larger than the other perforations on the perforated disk, to position the perforated disk firmly on the support.

According to a preferred embodiment of the invention, the perforated disk is made of steel, preferably by punching, and has a thickness of about 0.1 mm.

The invention will be explained in more detail below based on a preferred embodiment with reference to the accompanying drawing.

DETAILED DESCRIPTION OF THE PREFERRED EMBODIMENT

Figure 1:
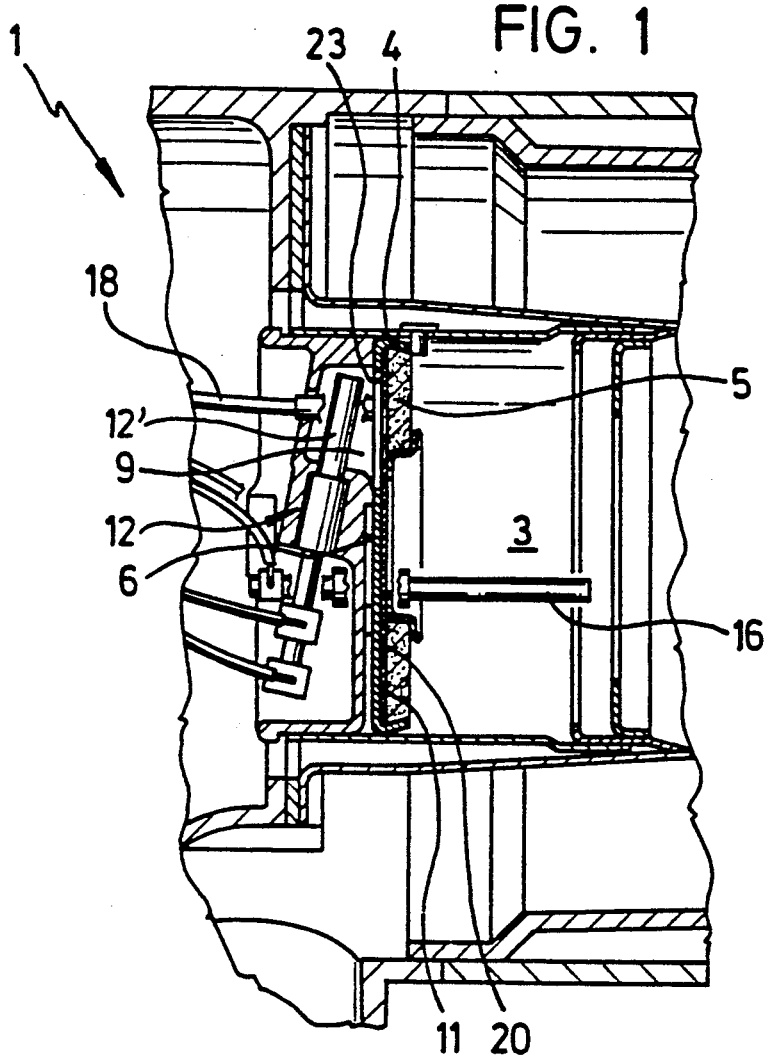
FIG. 1 is a diagrammatic axial section view of a vaporization burner in its installed state in the combustion chamber.

In FIG. 1, 1 designates a vaporization burner, intended for a heater operating with liquid fuel, such as an auxiliary vehicle heater, and which projects into a pipe-shaped combustion chamber 3 of the heater. Vaporization burner 1 has a support 4 for an absorbent body 5, which is made, for example, of a nonwoven fabric in the form of a disk, or can be a ceramic body. An ignition chamber 9 is located behind the support 4 for absorbent body 5, i.e., on back side 6 of the latter. As an ignition device 12, a rod-type glow plug 12' projects into ignition chamber 9. A flame monitor 16, which projects into combustion chamber 3 and acts to monitor the flame in the usual way, passes through the support 4 for absorbent body 5. A fuel feed pipe 18 is attached to support 4, and has an outlet opening which is exposed at the front side 11 of support 4.

Figure 2:
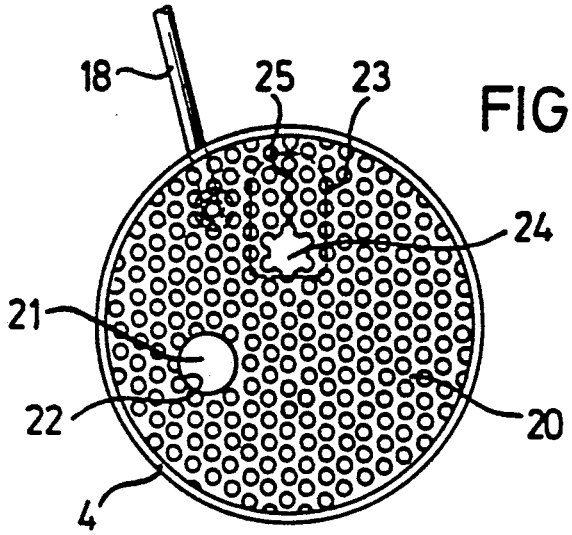
FIG. 2 is a front view of the support of the vaporization burner of FIG. 1 seen starting from the combustion chamber, and with the absorbent body omitted.

A perforated disk, designated by 20, and whose configuration is shown in more detail in FIG. 2, is placed between the front side 11 of support 4 and absorbent body 5. This perforated disk 20 is suitably made of a steel and has a thickness of about 0.1 mm. As can be seen especially in FIG. 2, perforated disk 20 has an evenly distributed perforation pattern over its entire surface. The diameter of the perforations on perforated disk 20 is about between 2 and 2.2 mm. Further, perforated disk 20 exhibits a through-hole 21 through which flame monitor 16, shown in FIG. 1, passes and whose diameter is about the same size as a through-hole 22 for the flame monitor in support 4. With help of this through-hole 21, a firm positioning for perforated disk 20 on front side 11 of support 4 can be thus achieved.

In passage 23, that can be seen in FIG. 1 and that produces a flow connection between ignition chamber 9 and the front side, facing combustion chamber 3, of absorbent body 5 in the area of combustion chamber 3, according to FIG. 2, perforated disk 20 has a through-hole 24 that is larger than the perforations distributed over perforated disk 20. However, this through-hole 24 is smaller than the area of passage 23, so that a part of passage 23 is covered by perforated disk 20. In this way, absorbent body 5 is at least partially supported by perforated disk 20 over passage 23 and stabilized by it. Simultaneously, the temperature distribution can be evened out as a result of the heat conduction on perforated disk 20 overall and particularly at this passage 23. In particular, soot formations on absorbent body 5 at this passage 23, from ignition chamber 9 and combustion chamber 3, can be avoided during the combustion operation of vaporization burner 1.

As can further be seen in FIG. 2, a continuous, slot-shaped notch 25 extends, starting from through-hole 24, to the edge area of perforated disk 20. By the absence of the material of perforated disk 20 at this notch 25, it is achieved that the perforated disk will not bulge at operating temperatures occurring during the combustion operation and because of thermal expansions caused by the latter, so that perforated disk 20 lies flat and reliably against front side 11 of support 4.

According to the respective flowability of the desired liquid fuel, the perforation pattern of perforated disk 20 for a vaporization burner for diesel fuel can differ from that for gasoline as a liquid fuel.

Additionally, as is known from the above-mentioned published German application 39 14 611, the absorbent body can either have a relatively large central opening (shown in FIG. 1 for absorbent body 5) which exposes a portion of the underlying support 4 to enable it to be directly heated for assisting in vaporization of less volatile fuels, such as diesel fuel, or the absorbent body may cover the entire surface of the support facing the combustion chamber for use with liquid fuels such as gasoline. In the former case, the heat of the flame will ultimately burn up the portion of the perforated disk 20 which is exposed by the opening in the absorbent body 5. However, this is of no significance since the disk 20 serves it disclosed function only where it extends along the back of the absorbent body 5. Thus, it would be possible to provide disk 20 with a cutout matched to such a central opening of the absorbent body 5; however, by not doing so, as shown, it is possible to use the same perforated disk 20 irrespective of whether diesel fuel and a centrally open absorbent body or gasoline and a centrally closed abasorbent body is to be used.

The way perforated disk 20 operates in vaporization burner 1 is explained in more detail below.

Between front side 11 of support 4, i.e., between the side fo support 4 facing combustion chamber 3, and the corresponding contact area of perforated disk 20 there results, thanks to the perforation pattern, a capillary action that distributes the fuel fed by fuel feed pipe 18 evely over the contact area of absorbent body 5. Simultaneously, the perforations of perforated disk 20 cause a division of this entering fuel stream into numerous partial streams. In this way, the combustion performance of vaporization burner 1 is favorable overall, and also there is no danger that, in a critical installation position, for example, in the vertical state, drops of the liquid fuel can escape. Especially in the start-up phase of the heater equipped with such a vaporization burner 1, the CO content of the exhaust gases can be reduced. Since perforated disk 20 partially covers passage 23 because of the smaller through-hole 24 provided there, the temperature distribution can be evened out using the heat conduction of perforated disk 20, so that a better heat distribution is achieved at absorbent body 5 in addition to the even fuel distribution. In this way, soot formation on absorbent body 5 in the area of passage 23 can be counteracted.

What is claimed:

1. Vaporization burner for a heater operated with liquid fuel comprising a support that projects into a combustion chamber, a front side of of the support facing the combustion chamber carrying an absorbent body that can be acted on with fuel supplied by a fuel feed pipe and an ignition chamber having an igniter being located at a back side of the support, a passage in the support leading from the .ignition chamber to the combustion chamber; wherein a perforated disk is located between the support and the absorbent body, said perforated disk having a through-hole in the area of said passage; and wherein a slot-shaped notch runs from said through-hole up to an edge of the perforated disk.

2. Vaporization burner according to claim 1, wherein the perforations of the perforated disk are distributed evenly on it.

3. Vaporization burner according to claim 2, wherein the perforations have a diameter of about 2 to 2.2 mm.

4. Vaporization burner according to claim 2, wherein the support has a through-hole for a flame monitor projecting into the combustion chamber; and wherein the perforated disk has a second through-hole of a size corresponding to the diameter of the through-hole for the flame monitor.

5. Vaporization burner according to claim 4, wherein the through-hole of the perforated disk in the area of said passage in the support is smaller than said passage.

6. Vaporization burner according to claim 5, wherein the perforated disk is formed of steel and is about 0.1 mm thick.

7. Vaporization burner according to claim 1, wherein the support has a through-hole for a flame monitor projecting into the combustion chamber; and wherein the perforated disk has a second through-hole of a size corresponding to the diameter of the through-hole for the flame monitor.

8. Vaporization burner according to claim 7, wherein the through-hole of the perforated disk in the area of said passage in the support is smaller than said passage.

9. Vaporization burner according to claim 8, wherein the perforated disk is formed of steel and is about 0.1 mm thick.

10. Vaporization burner according to claim 2, wherein the through-hole of the perforated disk in the area of said passage in the support is smaller than said passage.

11. Vaporization burner according to claim 10, wherein the perforated disk is formed of steel and is about 0.1 mm thick.

12. Vaporization burner according to claim 2, wherein the perforated disk is formed of steel and is about 0.1 mm thick.

13. Vaporization burner according to claim 1, wherein the perforations have a diameter of about 2 to 2.2 mm.

14. Vaporization burner according to claim 13, wherein the support has a through-hole for a flame monitor projecting into the combustion chamber; and wherein the perforated disk has a second through-hole of a size corresponding to the diameter of the through-hole for the flame monitor.

15. Vaporization burner according to claim 14, wherein the through-hole of the perforated disk in the area of said passage in the support is smaller than said passage.

16. Vaporization burner according to claim 15, wherein the perforated disk is formed of steel and is about 0.1 mm thick.

17. Vaporization burner according to claim 1, wherein the through-hole of the perforated disk in the area of said passage in the support is smaller than said passage.

18. Vaporization burner according to claim 17, wherein the perforated disk is formed of steel and is about 0.1 mm thick.

19. Vaporization burner according to claim 1, wherein the perforated disk is formed of steel and is about 0.1 mm thick.

20. Vaporization burner according to claim 1, wherein said perforated disk forms a means for producing a capillary action between the front side of the support body and said perforated disk for evenly distributing the fuel over said absorbent body.

* * * * *